US010665937B2

(12) United States Patent
Islam et al.

(10) Patent No.: US 10,665,937 B2
(45) Date of Patent: May 26, 2020

(54) ANTENNA SYSTEM AND WIRELESS COMMUNICATION DEVICE HAVING A SECONDARY CONDUCTIVE STRUCTURE WHICH EXTENDS INTO AN AREA FORMING A LOOP

(71) Applicant: Motorola Mobility LLC, Chicago, IL (US)

(72) Inventors: Md Rashidul Islam, Lombard, IL (US); Mohammed Abdul-Gaffoor, Palatine, IL (US); Joshua Boerman, Lake Zurich, IL (US); Daniel Philip Groebe, Lake Zurich, IL (US)

(73) Assignee: Motorola Mobility LLC, Chicago, IL (US)

( * ) Notice: Subject to any disclaimer, the term of this patent is extended or adjusted under 35 U.S.C. 154(b) by 217 days.

(21) Appl. No.: 15/862,538

(22) Filed: Jan. 4, 2018

(65) Prior Publication Data

US 2019/0207307 A1 Jul. 4, 2019

(51) Int. Cl.

| | |
|---|---|
| ***H01Q 1/52*** | (2006.01) |
| ***H01Q 7/00*** | (2006.01) |
| ***H01Q 1/24*** | (2006.01) |
| ***H01Q 13/10*** | (2006.01) |

(52) U.S. Cl.

CPC ..... *H01Q 1/528* (2013.01); *H01Q 1/243* (2013.01); *H01Q 7/00* (2013.01); *H01Q 13/103* (2013.01)

(58) Field of Classification Search

CPC ..... H01Q 1/528; H01Q 1/243; H01Q 7/00

See application file for complete search history.

(56) References Cited

U.S. PATENT DOCUMENTS

2017/0201010 A1* 7/2017 Kim ..... H01Q 9/42

* cited by examiner

*Primary Examiner* — Graham P Smith

(74) *Attorney, Agent, or Firm* — Loppnow & Chapa

(57) ABSTRACT

The present application provides an antenna system for use in an electronic device having wireless communication capabilities. The antenna system includes a conductive ground structure and one or more arms. Each arm of the one or more arms having two ends and a conductive path between the two ends, where a first one of the two ends of the arm is coupled to the conductive ground structure. From the first end and along the conductive path, the arm extends along an edge of the conductive ground structure a distance away from the conductive ground structure, where the distance between the edge of the conductive ground structure and the corresponding conductor path of the respective one of the one or more arms encompasses an area forming a loop which is internal to the antenna system. The antenna system further includes a secondary conductive structure, coupled to the conductive ground structure, which extends into the area forming the loop which is internal to the antenna system.

14 Claims, 3 Drawing Sheets

ANTENNA SYSTEM AND WIRELESS COMMUNICATION DEVICE HAVING A SECONDARY CONDUCTIVE STRUCTURE WHICH EXTENDS INTO AN AREA FORMING A LOOP

FIELD OF THE APPLICATION

The present disclosure relates generally to antenna systems or electronic devices with an antenna, and more particularly, antenna systems having an area forming a loop into which a secondary conductive structure extends.

BACKGROUND

Electronic devices, such as smartphones, are increasingly supporting use cases, where for certain functionality, it is desirable for the device to be able to support a larger display size. For example, larger display sizes can be desirable for viewing visual content as part of a media player or a browser, as well as for supporting the visual presentation of information as part of an application or program that is being executed by the device. However, such a trend needs to be balanced with a general desire for the overall size of the device to stay the same and even decrease in one or both of dimension and weight.

In an attempt to support larger display sizes without increasing the overall size of the device, device manufacturers have increasingly dedicated a larger percentage of the exterior surface to a display, where the display in many instances has grown in one or more dimensions to a size that dominates a particular surface, such as the front surface of the device. In at least some of these instances, the display has been allowed to extend into areas that had previously been used to support user inputs, such as areas of the surface that have previously supported a keypad, such as a numeric keypad.

Larger displays often means less housing, as the larger displays are accompanied by larger openings in the housing. In turn the larger openings typically reduce the amount of material that is available to support the structural integrity of the housing, and correspondingly the device. As such, manufacturers are increasingly relying upon materials in the formation of the device housings, such as metals, that have historically better maintained structural integrity with less overall material. This is true for devices having a full metal rear housing, as well as devices that incorporate perimeter metal housings.

However, housings made from conductive materials, such as metal, can interfere with the transmission and reception of wireless signals into and out of the device. Further openings can be made in the housing proximate the location of the antennas, which support wireless communication signal transmission/reception, in order to create an area through which wireless signaling can propagate. Alternatively, the antennas can be formed into the housing materials with cuts and/or further openings which isolate the antenna portions from the non-antenna portions of the housing. However, to the extent that cuts or further openings need to be made in the housing, the further openings and/or cuts can further affect the structural integrity. The further openings and/or cuts can also affect the aesthetics of the device.

In addition to the conductive structures associated with the housing, conductive structures associated with other auxiliary electronic elements can impact the functioning of a nearby antenna, which given the limited overall space constraints in some devices can present design challenges.

For example, in some instances a conductive element proximate to a radiating structure, such as an antenna, can result in an unwanted electromagnetic coupling between the two, which can impact the intended performance of the radiating structure. As such, at least some designs will designate keep out areas, which are intended to avoid an unwanted interaction from other objects, such as conductive elements, from encroaching and impacting the operation of a radiating structure. Conductive elements can include conductive housing portions, as well as conductive elements internal to the device.

The present innovators have recognized that conductive elements within a traditional keep out area is possible while minimizing the potential negative effects on a radiating structure, if the conductive elements have been detuned in the frequencies of interest. Such a detuning can allow areas that were previously restricted to be used for the placement of conductive elements and/or an extension of conductive housing portions or structure. In other words, conductive structures and/or elements with appropriate detuning can be positioned more proximate an antenna structure while reducing the negative effects on an antenna structure associated with the related conductive structures and/or elements.

SUMMARY

The present application provides an antenna system for use in an electronic device having wireless communication capabilities. The antenna system includes a conductive ground structure and one or more arms. Each arm of the one or more arms having two ends and a conductive path between the two ends, where a first one of the two ends of the arm is coupled to the conductive ground structure. From the first end and along the conductive path, the arm extends along an edge of the conductive ground structure a distance away from the conductive ground structure, where the distance between the edge of the conductive ground structure and the corresponding conductor path of the respective one of the one or more arms encompasses an area forming a loop which is internal to the antenna system. The antenna system further includes a secondary conductive structure, coupled to the conductive ground structure, which extends into the area forming the loop which is internal to the antenna system.

In at least one embodiment, a distance between the secondary conductive structure and at least one of the one or more arms forms a slot.

In at least a further embodiment, the slot extends along the conductive path of the at least one of the one or more arms to at least the first one of the two ends of the arm, which is coupled to the conductive ground structure.

The present application further provides a wireless communication device. The wireless communication device includes a controller, a transceiver coupled to the controller, and an antenna system. The antenna system includes a conductive ground structure and one or more arms. Each arm of the one or more arms having two ends and a conductive path between the two ends, where a first one of the two ends of the arm is coupled to the conductive ground structure. From the first end and along the conductive path, the arm extends along an edge of the conductive ground structure a distance away from the conductive ground structure, where the distance between the edge of the conductive ground structure and the corresponding conductor path of the respective one of the one or more arms encompasses an area forming a loop which is internal to the antenna system. The antenna system further includes a secondary conductive structure, coupled to the conductive ground structure, which extends into the area forming the loop which is internal to the antenna system.

These and other features, and advantages of the present disclosure are evident from the following description of one or more preferred embodiments, with reference to the accompanying drawings.

DETAILED DESCRIPTION OF THE PREFERRED EMBODIMENT(S)

Figure 1:
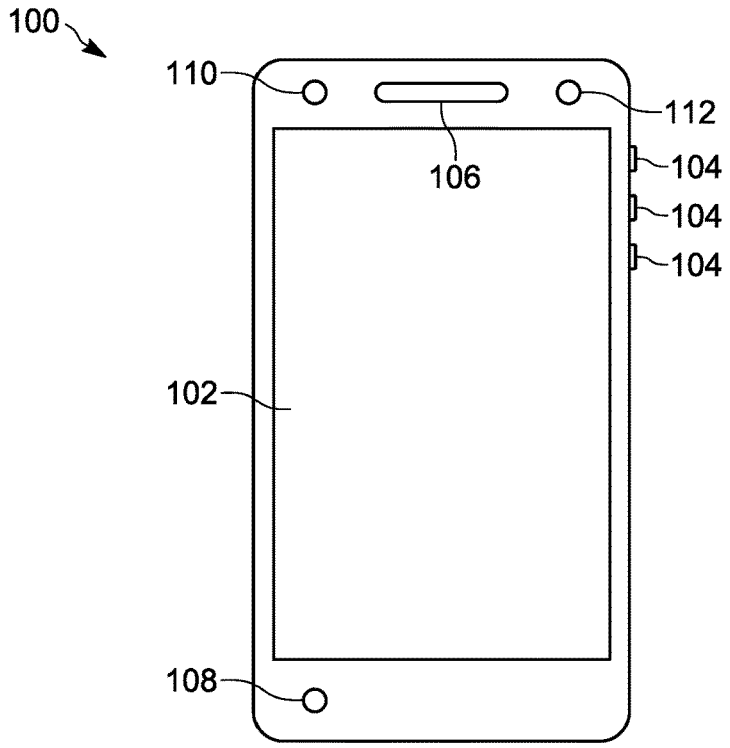
FIG. 1 is a front view of an exemplary wireless communication device.

While the present invention is susceptible of embodiment in various forms, there is shown in the drawings and will hereinafter be described presently preferred embodiments with the understanding that the present disclosure is to be considered an exemplification and is not intended to limit the invention to the specific embodiments illustrated. One skilled in the art will hopefully appreciate that the elements in the drawings are illustrated for simplicity and clarity and have not necessarily been drawn to scale. For example, the dimensions of some of the elements in the drawings may be exaggerated relative to other elements with the intent to help improve understanding of the aspects of the embodiments being illustrated and described.

FIG. 1 illustrates a front view of an exemplary wireless communication device 100, such as a wireless communication device. While in the illustrated embodiment, the type of wireless communication device shown is a radio frequency cellular telephone, other types of devices that include wireless radio frequency communication capabilities are also relevant to the present application. In other words, the present application is generally applicable to wireless communication devices beyond the type being specifically shown. A couple of additional examples of suitable wireless communication devices that may additionally be relevant to the present application in the incorporation and management of an antenna as part of the housing can include a tablet, a laptop computer, a desktop computer, a netbook, a cordless telephone, a selective call receiver, a gaming device, a personal digital assistant, as well as any other form of wireless communication device that might be used to manage wireless communications including wireless communications involving one or more different communication standards. A few examples of different communication standards include Global System for Mobile Communications (GSM) Code Division Multiple Access (CDMA), Orthogonal Frequency Division Multiple Access (OFDMA), Long Term Evolution (LTE), Global Positioning System (GPS), Bluetooth®, Wi-Fi (IEEE 802.11), Near Field Communication (NFC) as well as various other communication standards. In addition, the wireless communication device 100 may utilize a number of additional various forms of communication including systems and protocols that support a communication diversity scheme, as well as carrier aggregation and simultaneous voice and data signal propagation.

In the illustrated embodiment, the radio frequency cellular telephone includes a display 102 which covers a large portion of the front facing. In at least some instances, the display can incorporate a touch sensitive matrix, that can help facilitate the detection of one or more user inputs relative to at least some portions of the display, including an interaction with visual elements being presented to the user via the display 102. In some instances, the visual element could be an object with which the user can interact. In other instances, the visual element can form part of a visual representation of a keyboard including one or more virtual keys and/or one or more buttons with which the user can interact and/or select for a simulated actuation. In addition to one or more virtual user actuatable buttons or keys, the device 100 can include one or more physical user actuatable buttons 104. In the particular embodiment illustrated, the device has three such buttons located along the right side of the device.

The exemplary wireless communication device 100, illustrated in FIG. 1, additionally includes a speaker 106 and a microphone 108 in support of voice communications. The speaker 106 may additionally support the reproduction of an audio signal, which could be a stand-alone signal, such as for use in the playing of music, or can be part of a multimedia presentation, such as for use in the playing of a movie, which might have at least an audio as well as a visual component. The speaker may also include the capability to produce a vibratory effect. However, in some instances, the purposeful production of vibrational effects may be associated with a separate element, not shown, which is internal to the device. Generally, the speaker 106 is located toward the top of the device 100, which corresponds to an orientation consistent with the respective portion of the device facing in an upward direction during usage in support of a voice communication. In such an instance, the speaker 106 might be intended to align with the ear of the user, and the microphone 108 might be intended to align with the mouth of the user. Also located near the top of the device, in the illustrated embodiment, is a front facing camera 110, and a corresponding flash 112.

Figure 2:
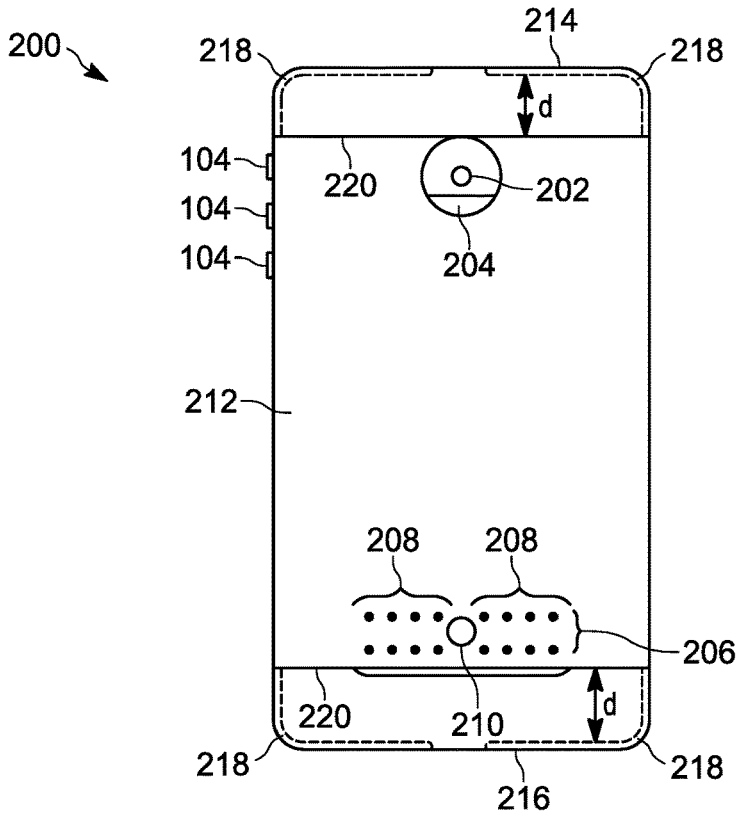
FIG. 2 is a back view of a previous wireless communication device.

FIG. 2 illustrates a back view 200 of previous wireless communication device. The illustrated back view similarly has the same three physical user actuatable buttons 104, which are visible in the front view. The illustrated back view of a wireless communication device additionally includes a back side facing camera 202 with a flash 204, as well as a peripheral communication interface 206. The peripheral communication interface 206 can be used to couple a secondary device, such as a peripheral to the main device, which can be used to enhance or extend the capabilities of the device. For example in the illustrated embodiment, the peripheral communication interface 206 includes multiple conductive elements, which are intended to connect with corresponding structure in another device, such as a peripheral that can be brought within proximity and/or in contact with the other device. More specifically, in the illustrated embodiment, the peripheral communication interface 206 can include conductive pins or ports 208 that allow individual signals to be conveyed to another device having a corresponding structure, electronically. The peripheral communication interface 206 can additionally include still further structure 210, such as a registration pin, that would support proper alignment with the corresponding structure of the other device. The peripheral communication interface 206 is generally adapted for conveying electrical signals, which can include data and/or power signals.

While a particular peripheral communication interface is illustrated, one skilled in the art will appreciate that the peripheral communication interface can take alternative and/or still further forms via which data and/or power signals can be conveyed between a peripheral and a base device. In at least some instances, the structure that can support such an interface can include forms which are compatible with various industry standards, such as Universal Serial Bus (USB), Peripheral Component Interconnect Express (PCIE), Subscriber Identity Module (SIM), etc., type standards and/or interfaces.

In the particular embodiment illustrated, the back view has a rear housing portion 212, which can be comprised of a conductive material, which in at least the illustrated embodiment corresponding to at least some prior embodiments, does not extend the full length/height of the device. More specifically, the ends 220 of the rear housing portion 212 stops short of both the top end 214 and the bottom end 216 of the device proximate the areas where multiple arms 218 formed in an outer side band of the housing can extend around the areas forming one or more of the device corners, where the multiple arms are each intended to function as an antenna. In at least some instances, the outer side band extends around the outer side perimeter of the device. By stopping short of the ends 214 and 216, a rear housing portion made of a conductive material can avoid extending into an area that might impact the performance of the multiple arms functioning as elements for radiating and/or receiving electromagnetic energy, such as an antenna.

The rear housing portion 212 being comprised of a conductive material can serve as and/or be a part of a conductive ground structure against which the signal traveling along a respective one of the arms can radiate. The conductive ground structure can also provide a return path for any currents associated with the wireless signaling. The distance d, that the respective arm extends beyond the corresponding end 214 or 216, helps serve to define an area corresponding to a loop that is internal to the antenna structure. While the conductive ground structure, in the illustrated embodiment, has been associated with an external housing surface, the conductive ground structure can also and/or alternatively be incorporated into other conductive elements, such as a circuit board substrate internal to the housing, a back side surface insert, and/or a housing for a secondary device or peripheral that might be coupled to the main device.

Figure 3:
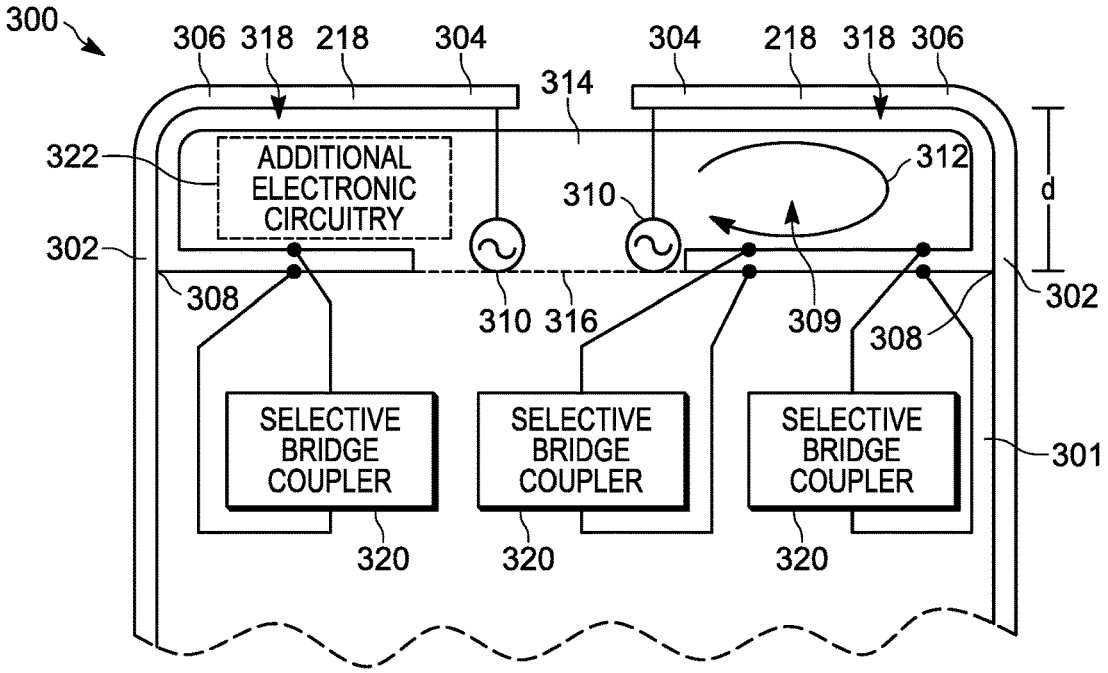
FIG. 3 is a partial front schematic view of an exemplary communication device including a conductive ground structure, such as a device with a housing having a plurality of arms integrated as part of the housing for forming a loop antenna structure.

FIG. 3 illustrates a partial front schematic view 300 of an exemplary wireless communication device including a conductive ground structure 301, such as a device with a housing having a plurality of arms integrated as part of the housing for forming a loop antenna structure. Similar to the embodiment illustrated in FIG. 2, the partial front schematic view includes a pair of arms 218 which extend from opposite side edges of a conductive ground structure 301 proximate one of the top or bottom ends 214 or 216 of the device. Each arm includes two ends 302 and 304, and a conductive path 306, which extends between the two ends 302 and 304 a distance "d" away from the conductive ground structure 301. A first one 302 of the two ends of the arm 218 is coupled to the conductive ground structure 301 at a point 308 where a respective conductive side edge of the housing meets the conductive ground structure 301. The distance "d" that the conductive path 306 of the corresponding arm extends away from the conductive ground structure 301 encloses an area 309 forming a loop which is internal to the antenna structure. The second one 304 of the two ends of the arm 218 ends a distance away from the conductive ground structure 301. In the illustrated embodiment, the second one 304 of the two ends of each of the respective arms 218 is coupled to a corresponding signal source 310, which supplies a signal to be transmitted to the radiating structure formed by the arrangement of each of the arms relative to the conductive ground structure. The signal source 310 in combination with the respective arm 218 and the conductive ground structure 301 serves to help complete the loop of the loop antenna, which has a respective current path 312.

In addition to the conductive ground structure 301, the partial front schematic view illustrated in FIG. 3 further provides a secondary conductive structure 314, which is coupled to the conductive ground structure 301 and which extends into the area 309 forming the loop which is internal to the antenna system. In the illustrated embodiment, the secondary conductive structure 314 is coupled to the conductive ground structure 301 at a point across the area 309 forming the loop, which is opposite the second one 304 of the two ends of the respective arms 218, which is not more directly coupled to the conductive ground structure 301. In the particular embodiment illustrated, the point of coupling corresponds more closely to an area identified by a dashed line 316, proximate where the signal sources 310 are shown.

The secondary conductive structure 314, as illustrated, occupies a space in the area 309 forming a loop which is internal to the antenna system, which stops short of physically touching the respective arms 218. The distance between the secondary conductive structure 314 and each of the respective arms 218 forms a slot 318. The slot 318 extends along the conductive path 306 of the respective arm 218 to at least the first one 302 of the two ends of the arm 218, which is coupled to the conductive ground structure. In the illustrated embodiment, the slot 318 extends beyond the first one 302 of the two ends of the arm 218, where the slot 318 continues to extend along a boundary between the secondary conductive structure 314 and the conductive ground structure 301. The slot 318 ends at the point where the secondary conductive structure 314 couples 316 to the conductive ground structure 301.

Often conductive structures that are present in the area 309 forming a loop which is internal to the antenna system, can electromagnetically couple to the arms, which in turn can affect the resonant frequencies of electromagnetic energy that the arm structures can be better tuned to either transmit or receive. Still further, because a conductive structure can extend across multiple areas associated with multiple different radiating structures, such as multiple arms, the corresponding conductive structure can be the source of cross coupling between the different radiating structures.

In the particular embodiment illustrated, the length of the slot 318 which extends along the boundary between the secondary conductive structure 314 and the conductive ground structure 301 can be used to detune the electromagnetic coupling between the secondary conductive structure 314 and the respective arms 218 for certain frequencies of interest despite encroaching upon the area 309 forming a loop which is internal to the antenna system. The particular frequencies for which the electromagnetic coupling can be detuned can be managed by controlling the effective length of the slot 318 along the boundary between the secondary conductive structure 314 and the conductive ground structure 301. While the physical slot length is often generally fixed, an effective slot length or virtual slot length can be created through the selective coupling of the secondary conductive structure 314 to the conductive ground structure 301.

In the illustrated embodiment, one or more selective bridge couplers 320 can be used at different points along the length of the slot 318 to selectively couple the secondary conductive structure 314 and the conductive ground structure 301 to alter the effective length of the slot 318. In turn, this can be coordinated with the current desired wireless communication operating frequencies being used with the one or more radiating structures, such as the one or more arms 218, so as to enable the radiating structures to continue to operate in a sufficient manner despite the presence of a conductive structure being present within the respective area 309 forming a loop which is internal to the antenna system. For example, a particular slot length, actual or virtual, could be effective for detuning the interaction between the secondary conductive structure 314 and a particular one of the arms 218 for a particular range of frequencies. Other particular slot lengths could relate to the corresponding detuning relative to other ranges of frequencies. In at least some instances, an ability to adjust the slot length can be used to coordinate the use of low band signals with high band signals, and in other instances an ability to adjust the slot length can be used to coordinate the use of ultra low band signals with mid band frequencies. Other combinations are further possible.

In at least some instances, once a secondary conductive structure 314 has been detuned relative to a particular radiating structure, the secondary conductive structure 314 can be used to shield other conductive structures, such as additional electronic circuitry 322, that might be present in the area 309 forming a loop which is internal to the antenna system to the extent that the other conductive structures are present within and/or do not effectively extend beyond the constraints of the secondary conductive structure 314. For example, additional electronic circuitry 322 can include various combinations of other circuit elements, such as display segments, speakers, microphones, sensor, and/or other elements incorporating conductive portions. The additional electronic circuitry 322 could also include all or parts of various selective bridge coupler circuits 320, which are capable of selectively coupling the secondary conductive structure 314 and the conductive ground structure 301 for affecting the effective or virtual length of the corresponding slot 318.

By allowing a secondary conductive element 314 to extend into the area 309 forming the loop which is internal to the antenna system, conductive elements that previously avoided this area can be included or extended into this area, while working to reduce any adverse effects that might have otherwise resulted from the inclusion of a conductive element into this area. For example, a metal back can now also include portions that extend into this area, which might be more visually pleasing than a metal back that might otherwise have avoided this area. Such a metal back might be included as part of the original housing, as part of a drop in insert that could be selectively applied to the housing, and/or as part of a secondary device or peripheral/accessory that might be coupled to the main device. Still further, the conductive portions of the secondary conductive element 314 could be uniformly solid, or could include one or more patterns, which might contribute to a desired visual or aesthetic effect.

Figure 4:
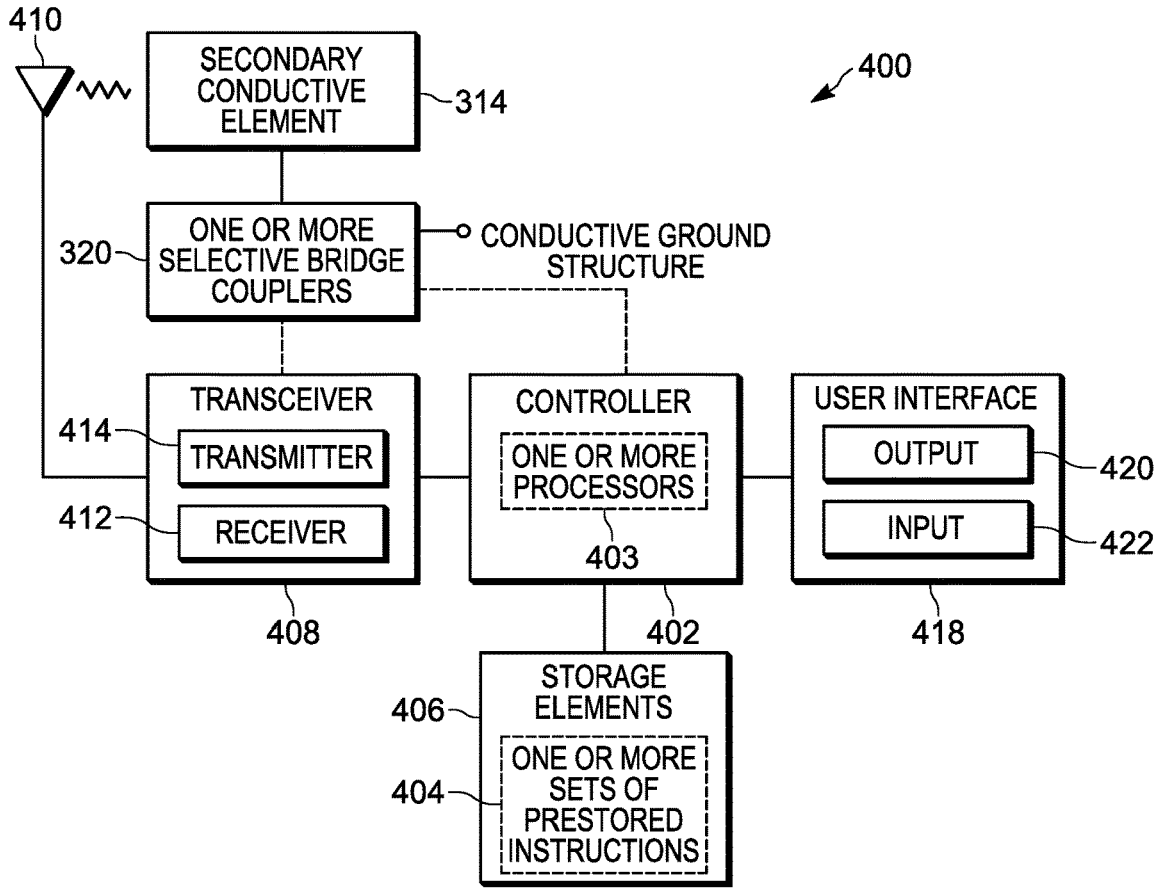
FIG. 4 is a block diagram of an exemplary wireless communication device.

FIG. 4 illustrates a block diagram 400 of an exemplary electronic device 100, according to a possible embodiment. In the illustrated embodiment, the exemplary electronic device 100 includes a controller 402, which is adapted for managing at least some of the operation of the device 100. In some embodiments, the controller 402 could be implemented in the form of one or more processors 403, which are capable of executing one or more sets of pre-stored instructions 404, which may be used to form or implement the operation of at least part of one or more controller modules including those used to manage wireless or wired communication. The one or more sets of pre-stored instructions 404 may be stored in a storage element 406, which while shown as being separate from and coupled to the controller 402, may additionally or alternatively include some data storage capability for storing at least some of the prestored instructions for use with the controller 402, that are integrated as part of the controller 402.

The storage element 406 could include one or more forms of volatile and/or non-volatile memory, including conventional ROM, EPROM, RAM, or EEPROM. The possible additional data storage capabilities may also include one or more forms of auxiliary storage, which is either fixed or removable, such as a hard drive, a floppy drive, or a memory stick. One skilled in the art will still further appreciate that still further forms of storage elements could be used without departing from the teachings of the present disclosure. In the same or other instances, the controller 402 may additionally or alternatively incorporate state machines and/or logic circuitry, which can be used to implement at least partially, some of the modules and/or functionality associated with the controller 402.

In the illustrated embodiment, the device further includes a transceiver 408, which is coupled to the controller 402 and which serves to manage the external communication of data including their wireless communication using one or more forms of communications. In such an instance, the transceivers will generally be coupled to an antenna 410 via which the wireless communication signals will be radiated and/or received. For example, the transceiver 408 might include a receiver 412, which supports the receipt of one or more communication signals, and a transmitter 414, which supports the transmission of one or more communication signals. In some instances, the transmitter 414 and receiver 412 will work together to support bidirectional forms of communication. In other instances, the transmitter 414 and receiver 412 can each separately support respective unidirectional forms of communication.

In the illustrated embodiment, the device 100 can further include one or more selective bridge couplers 320, which selectively couples the secondary conductive element 314 to the conductive grounding structure 301 for affecting the electrical characteristics of the secondary conductive element 314 as seen by each of the one or more arms 218, which function as an antenna 410 by adjusting the effective length of the slot 318. In turn, the degree to which the antenna 410 might electromagnetically couple to the secondary conductive element 314 for various operating signal frequencies can be better managed.

In at least some instances, at least some of the one or more selective bridge couplers 320 could each be associated with a respective switch, which could be suitably controlled by the transceiver 408 or the controller 402 to open or close depending upon the current intended operating frequency of the wireless communication. Depending upon the desired current operating frequency, different switches could be operated to control the effective slot length for purposes of detuning the secondary conductive element 314 and correspondingly controlling the ability of the secondary conductive element 314 to electromagnetically couple to the antenna 410 at the frequency of operation for the intended wireless communication. Closing a switch could effectively provide a short across the slot prior to its physical end, making the slot electrically appear shorter.

Alternatively and/or additionally, at least some of the one or more selective bridge couplers 320 could each incorporate a reactive load across the slot, each tuned to function as a short circuit for a different set of operating frequencies. This would allow the secondary conductive element 314 to be detuned relative to an electromagnetic coupling to each of the corresponding one or more arms 218 for each of a variety of different set of frequencies. An effective shorter slot length generally corresponds to detuning the undesired electromagnetic coupling for a higher frequency band of operation. The reactive load could include various inductive and capacitive elements in the form of lumped or distributed components.

In the illustrated embodiment, the device 100 can additionally include user interface circuitry 418, some of which can be associated with producing an output 420 to be perceived by a user, and some of which can be associated with detecting an input 422 from the user. For example, the user interface circuitry 418 can include a display that produces a visually perceptible output, which may further support a touch sensitive array for receiving an input from the user. The user interface circuitry 418 may also include a speaker for producing an audio output, and a microphone for receiving an audio input. The user interface output 420 could further include a vibrational element. The user interface input 422 could further include one or more user actuatable switches, one or more sensors, as well as one or more cameras. Still further alternative and additional forms of user interface elements may be possible without departing from the teaching of the present application.

Figure 5:
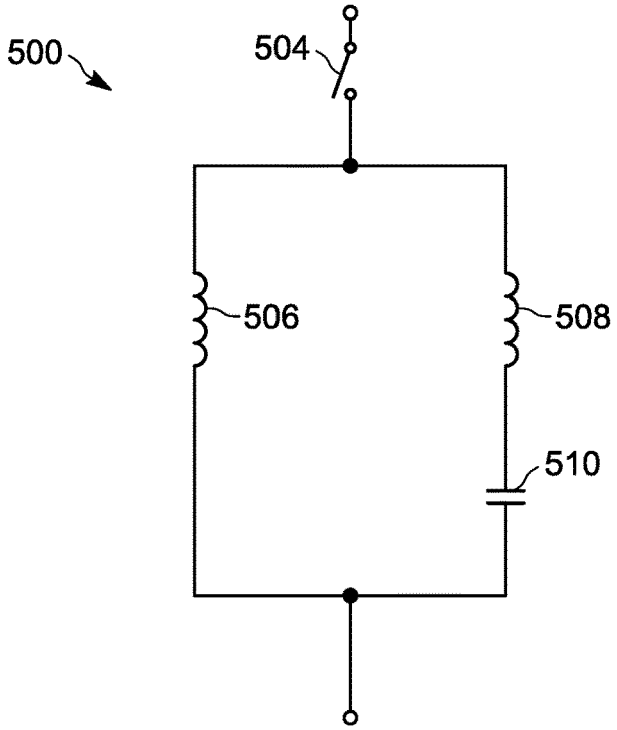
FIG. 5 is a schematic view of an exemplary selective bridge coupler.

FIG. 5 illustrates a schematic view of an exemplary selective bridge coupler circuit 500. The selective bridge coupler circuit 500 includes a switch 504, which can be used to control whether the circuit is acting as a shunt (switch closed) or not (switch open). The switch 504 is in series with the combination of an inductor 506 in parallel with the series combination of an inductor 508 and a capacitor 510. The values of the capacitor 510 and the inductors 506 and 508 can be selected to make the selective bridge coupler circuit 500 appear substantially electrically equivalent at one or more frequencies of interest to the portion of the arm 218 proximate the slot 318 that is being shunted by the selective bridge coupler circuit 500.

Figure 6:
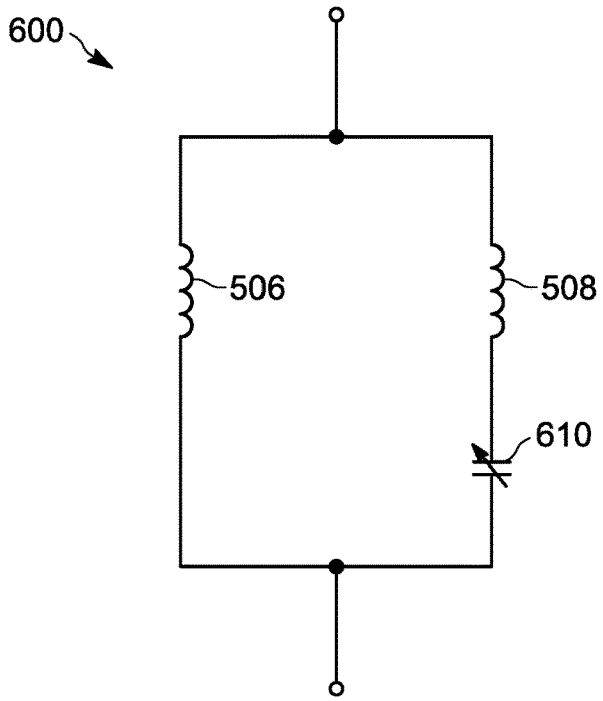
FIG. 6 is a schematic view of a further exemplary selective bridge coupler.

In an alternative embodiment, FIG. 6 illustrates a schematic view of a further exemplary selective bridge coupler circuit 600. The selective bridge coupler circuit 600, illustrated in FIG. 6, replaces the capacitor 510 with a variable capacitor 610, which allows the switch 504 to be eliminated. The variable capacitor 610 can be used to selectively tune and detune the selective bridge coupler circuit 600, so as to control the ability of the circuit to function as a shunt depending upon the frequency of the signal being transmitted or received.

While the preferred embodiments have been illustrated and described, it is to be understood that the invention is not so limited. Numerous modifications, changes, variations, substitutions and equivalents will occur to those skilled in the art without departing from the spirit and scope of the present invention as defined by the appended claims.

What is claimed is:

1. An antenna system for use in an electronic device having wireless communication capabilities, the antenna system comprising:

a conductive ground structure;

one or more arms, each arm having two ends and a conductive path between the two ends, where a first one of the two ends of the arm is coupled to the conductive ground structure, and where from the first end and along the conductive path, the arm extends along an edge of the conductive ground structure a distance away from the conductive ground structure, where the distance between the edge of the conductive ground structure and the corresponding conductor path of the respective one of the one or more arms encompasses an area forming a loop which is internal to the antenna system; and a secondary conductive structure, coupled to the conductive ground structure, and which extends into the area forming the loop which is internal to the antenna system wherein a second one of the two ends of the arm ends a distance away from the conductive ground structure;

wherein the secondary conductive structure couples to the conductive ground structure at a point across the area forming the loop, which is opposite the second one of the two ends of at least one of the one or more arms;

wherein a distance between the secondary conductive structure and at least one of the one or more arms forms a slot;

wherein the slot extends along the conductive path of the at least one of the one or more arms to at least the first one of the two ends of the arm, which is coupled to the conductive ground structure; and wherein the slot extends beyond the first one of the two ends of the arm, which is coupled to the conductive ground structure, where the slot continues to extend along a boundary between the secondary conductive structure and the conductive ground structure; and the antenna system further comprises a selective bridge coupler, which traverses the slot, and which selectively couples the secondary conductive structure to the conductive ground structure at a point prior to an end of the slot.

2. An antenna system in accordance with claim 1, wherein the slot ends at the point where the secondary conductive structure couples to the conductive ground structure.

3. An antenna system in accordance with claim 1, wherein the selective bridge coupler has an impedance which is frequency dependent.

4. An antenna system in accordance with claim 1, further comprising one or more additional selective bridge couplers, which traverse the slot at respective additional points along the length of the slot prior to the end of the slot.

5. An antenna system in accordance with claim 4, wherein each of additional selective bridge couplers has a frequency dependent impedance which has a frequency response that differs from the other selective bridge couplers.

6. An antenna system in accordance with claim 1, wherein the one or more arms includes multiple arms, where each arm forms a separate loop relative to the conductive ground structure.

7. An antenna system in accordance with claim 6, wherein each of the arms separately interact with the same or a different secondary structure, which extends into the respective separate loops to form a respective slot.

8. An antenna system for use in an electronic device having wireless communication capabilities, the antenna system comprising:

a conductive ground structure;

one or more arms, each arm having two ends and a conductive path between the two ends, where a first one of the two ends of the arm is coupled to the conductive ground structure, and where from the first end and along the conductive path, the arm extends along an edge of the conductive ground structure a distance away from the conductive ground structure, where the distance between the edge of the conductive ground structure and the corresponding conductor path of the respective one of the one or more arms encompasses an area forming a loop which is internal to the antenna system; and a secondary conductive structure, coupled to the conductive ground structure, and which extends into the area forming the loop which is internal to the antenna system;

wherein the one or more arms includes multiple arms, where each arm forms a separate loop relative to the conductive ground structure;

wherein each of the arms separately interact with the same or a different secondary structure, which extends into the respective separate loops to form a respective slot; and wherein each of the respective slots have one or more selective bridge couplers.

9. An antenna system in accordance with claim 1, wherein the antenna system is incorporated into a wireless communication device.

10. An antenna system in accordance with claim 9, wherein the wireless communication devices includes additional electronic circuitry that is co-located with the secondary conductive structure.

11. An antenna system in accordance with claim 9, wherein at least portions of the antenna system are incorporated as part of a housing for the wireless communication device.

12. An antenna system in accordance with claim 9, wherein at least portions of the antenna system are incorporated into a drop-in back surface.

13. An antenna system in accordance with claim 9, wherein at least portions of the antenna system are incorporated into an accessory that can be selectively coupled to the wireless communication device.

14. A wireless communication device comprising:

a controller;

a transceiver coupled to the controller; and an antenna system coupled to the transceiver, the antenna system having a conductive ground structure;

one or more arms, each arm having two ends and a conductive path between the two ends, where a first one of the two ends of the arm is coupled to the conductive ground structure, and where from the first end and along the conductive path, the arm extends along an edge of the conductive ground structure a distance away from the conductive ground structure, where the distance between the edge of the conductive ground structure and the corresponding conductor path of the respective one of the one or more arms encompasses an area forming a loop which is internal to the antenna system; and a secondary conductive structure, coupled to the conductive ground structure, and which extends into the area forming the loop which is internal to the antenna system;

wherein the one or more arms includes multiple arms, where each arm forms a separate loop relative to the conductive ground structure;

wherein each of the arms separately interact with the same or a different secondary structure, which extends into the respective separate loops to form a respective slot; and wherein each of the respective slots have one or more selective bridge couplers.

* * * * *